US007615960B2

(12) United States Patent
Morinaga et al.

(10) Patent No.: US 7,615,960 B2
(45) Date of Patent: Nov. 10, 2009

(54) ROTATION CONTROL DEVICE, ROTATION CONTROL METHOD AND CONSTRUCTION MACHINE

(75) Inventors: Jun Morinaga, Yokohama (JP); Tadashi Kawaguchi, Hiratsuka (JP); Hiroaki Inoue, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 394 days.

(21) Appl. No.: 11/596,206

(22) PCT Filed: May 13, 2005

(86) PCT No.: PCT/JP2005/008760

§ 371 (c)(1),
(2), (4) Date: Nov. 13, 2006

(87) PCT Pub. No.: WO2005/111322

PCT Pub. Date: Nov. 24, 2005

(65) Prior Publication Data

US 2007/0229007 A1 Oct. 4, 2007

(30) Foreign Application Priority Data

May 13, 2004 (JP) ..... 2004-143644

(51) Int. Cl.
*G05B 11/36* (2006.01)

(52) U.S. Cl. ..... 318/609; 318/610; 318/432

(58) Field of Classification Search ..... 318/609, 318/610, 461, 432, 434
See application file for complete search history.

(56) References Cited

U.S. PATENT DOCUMENTS

| | | | | |
|---|---|---|---|---|
| 5,384,526 | A * | 1/1995 | Bennett | 318/610 |
| 5,572,106 | A * | 11/1996 | Yamanashi et al. | 318/803 |
| 6,894,454 | B2 * | 5/2005 | Patel et al. | 318/700 |
| 7,067,999 | B2 * | 6/2006 | Sugano et al. | 318/372 |

FOREIGN PATENT DOCUMENTS

| | | | |
|---|---|---|---|
| JP | 06-313326 | A | 11/1994 |
| JP | 11-269937 | A | 10/1999 |
| JP | 2001-11897 | A | 1/2001 |
| JP | 2001-170119 | A | 6/2001 |
| JP | 2004-36304 | A | 2/2004 |

* cited by examiner

*Primary Examiner*—Rina I Duda
(74) *Attorney, Agent, or Firm*—Frishauf, Holtz, Goodman & Chick, P.C.

(57) ABSTRACT

In stopping a rotary body of an electric rotary excavator (a construction machine), a control-system changing unit of a rotation control device changes a control law from a speed control law to a position control law when a target speed is judged to be smaller than a speed threshold value. By changing to the position control, a larger braking torque can be output to an electric motor as compared with that in the speed control, thereby reliably maintaining the rotary body in a stationary state.

11 Claims, 13 Drawing Sheets

ROTATION CONTROL DEVICE, ROTATION CONTROL METHOD AND CONSTRUCTION MACHINE

TECHNICAL FIELD

This application is a U.S. National Phase Application under 35 USC 371 of International Application PCT/JP2005/008760 filed Mar. 13, 2005.

The present invention is applied to a construction machine on which a work machine is mounted. The present invention relates to a rotation control device and a rotation control method each for controlling a rotation of a rotary body driven by an electric motor, the invention also relating to a construction machine of which rotary body is rotated by an electric motor.

BACKGROUND ART

There has been developed a hybrid electric rotary excavator of which a rotary body is driven by an electric motor while a work machine and a carrier thereof are driven by a hydraulic actuator (see, for example, Patent Document 1).

In such an electric rotary excavator, the rotary body is rotated by the electric motor. Even when the rotary body is rotated at the same time of an elevation of a boom or an arm which is hydraulically driven, the movement of the rotary body is not affected by the elevation of the boom or the arm. Hence, the energy efficiency is better as compared to a case in which the rotary body is also driven hydraulically, since energy loss through a control valve and the like can be reduced.

[Patent Document 1] JP2001-11897A

DISCLOSURE OF THE INVENTION

Problems to be Solved by the Invention

However, when the electric rotary excavator is on a slant, the rotary body in a rotation toward the lower side of the slant cannot be completely stopped even when the rotary body is operated to be stopped, because the rotary body continues to move due to the weight of the boom or the arm to a lowest position. The rotary body coasts, though a rotation lever is returned to the neutral position to maintain the rotary body in a stationary state.

An object of the present invention is to provide a rotation control device, a rotation control method and a construction machine which can reliably maintain a rotary body in a stationary state.

Means for Solving the Problems

A rotation control device according to an aspect of the invention is applied to a construction machine on which a work machine is mounted. The rotation control device controls a rotation of a rotary body driven by an electric motor. The rotation control device includes: a control command generating means which generates and outputs a control command for the electric motor; a target speed judging means which judges whether or not a target speed of the rotary body which is generated based on an operation amount of an operating section is smaller than a predetermined threshold value; and a control-system changing means which changes a control system of the rotation control device in accordance with the judgment result by the target speed judging means.

In a rotation control device according to an aspect of the invention, the control-system changing means may preferably make a change in a control law of the control command generating means from a speed control to a position control or a change from a proportional control to a proportional-plus-integral control as a change of the control system.

In a rotation control device according to an aspect of the invention, the control-system changing means may preferably change a speed gain of the control command generating means as a change of the control system.

In a rotation control device according to an aspect of the invention, the control-system changing means may preferably change the speed gain from a small gain to a large gain.

A rotation control method according to an aspect of the invention is applied to a construction machine on which a work machine is mounted. The rotation control method controls a rotation of a rotary body driven by an electric motor. The rotation control method includes: a step for generating and outputting a control command for the electric motor; a step for judging whether or not a target speed of the rotary body which is generated based on an operation amount of an operating section is smaller than a predetermined threshold value; and a step for changing a control system of the rotation control method when the target speed is judged to be smaller than the predetermined threshold value.

In a rotation control method according to an aspect of the invention, in the step for changing the control-system of the rotation control method, a control law in the step for generating and outputting the control command may preferably be changed from a speed control to a position control or from a proportional control to a proportional-plus-integral control as a change of the control system.

In a rotation control method according to an aspect of the invention, in the step for changing the control-system of the rotation control method, a speed gain in the step for generating and outputting the control command may preferably be changed as a change of the control system.

A construction machine according to an aspect of the invention includes: a rotary body rotated by an electric motor; and a rotation control device according to an aspect of the invention for controlling the rotary body.

According to the aspects of the invention, when the target speed of the rotary body generated based on the operation amount of the operating section is judged to be smaller than the predetermined threshold value, the control law or the control parameter is changed as a change of the control system of the rotation control device. Hence, a larger braking torque than that of a normal control can be generated. Thereby, the rotary body can be reliably maintained in a stationary state.

EXPLANATION OF CODES

1: electric rotary excavator (construction machine), 4: rotary body, 5: electric motor, 10: rotation lever (operating section), 100: rotation control device, 130: control command generating means, 140: target speed judging means, 150: control-system changing means, K: speed gain (control gain)

BEST MODE FOR CARRYING OUT THE INVENTION

FIRST EMBODIMENT

[1-1] Overall Structure

A first embodiment of the present invention will be described below with reference to the attached drawings.

Figure 1A:
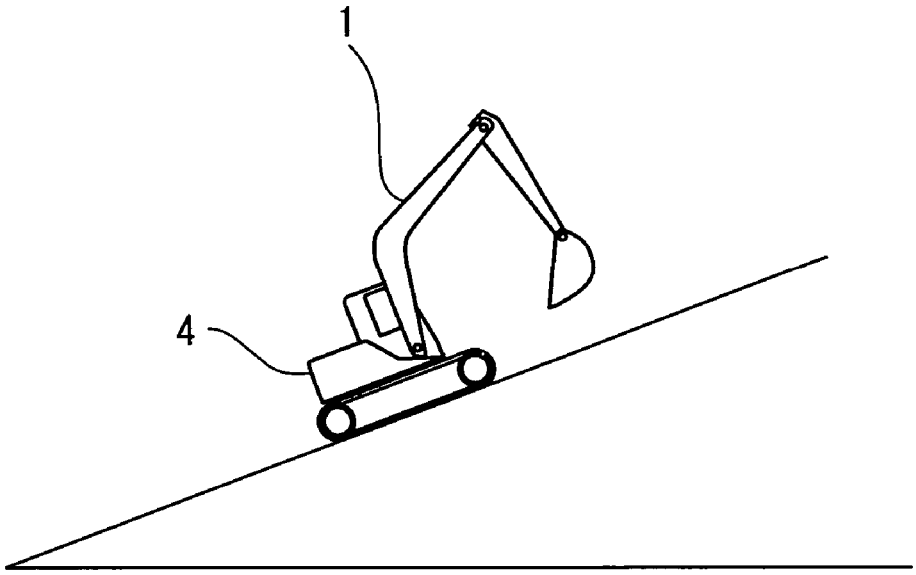
FIG. 1A is a schematic view showing a construction machine according to a first embodiment of the present invention, the construction machine being on a slant with a front side of a rotary body oriented to the higher side of the slant.
Figure 1B:
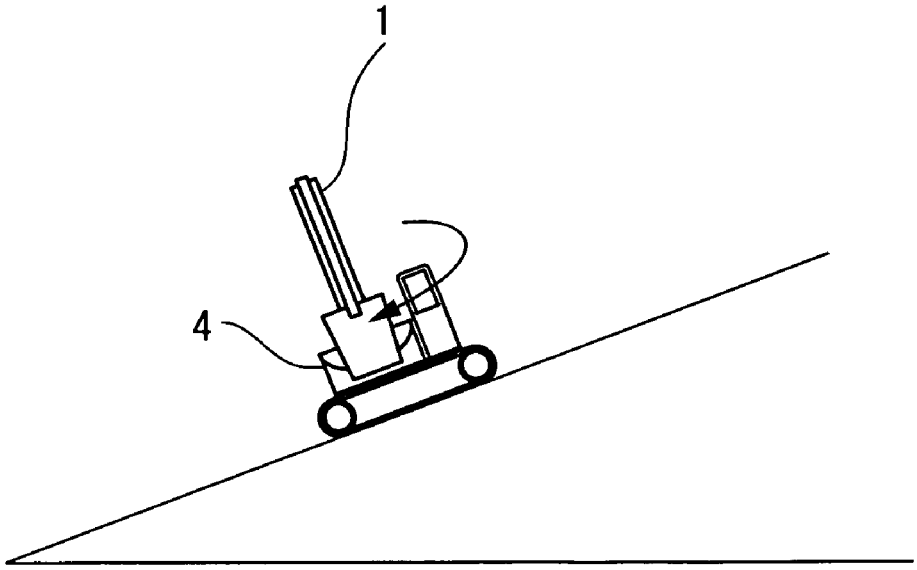
FIG. 1B is a schematic view showing the construction machine according to the first embodiment, of which rotary body is rotated toward the lower side of the slant and stopped in the rotation in a stationary state.
Figure 2:
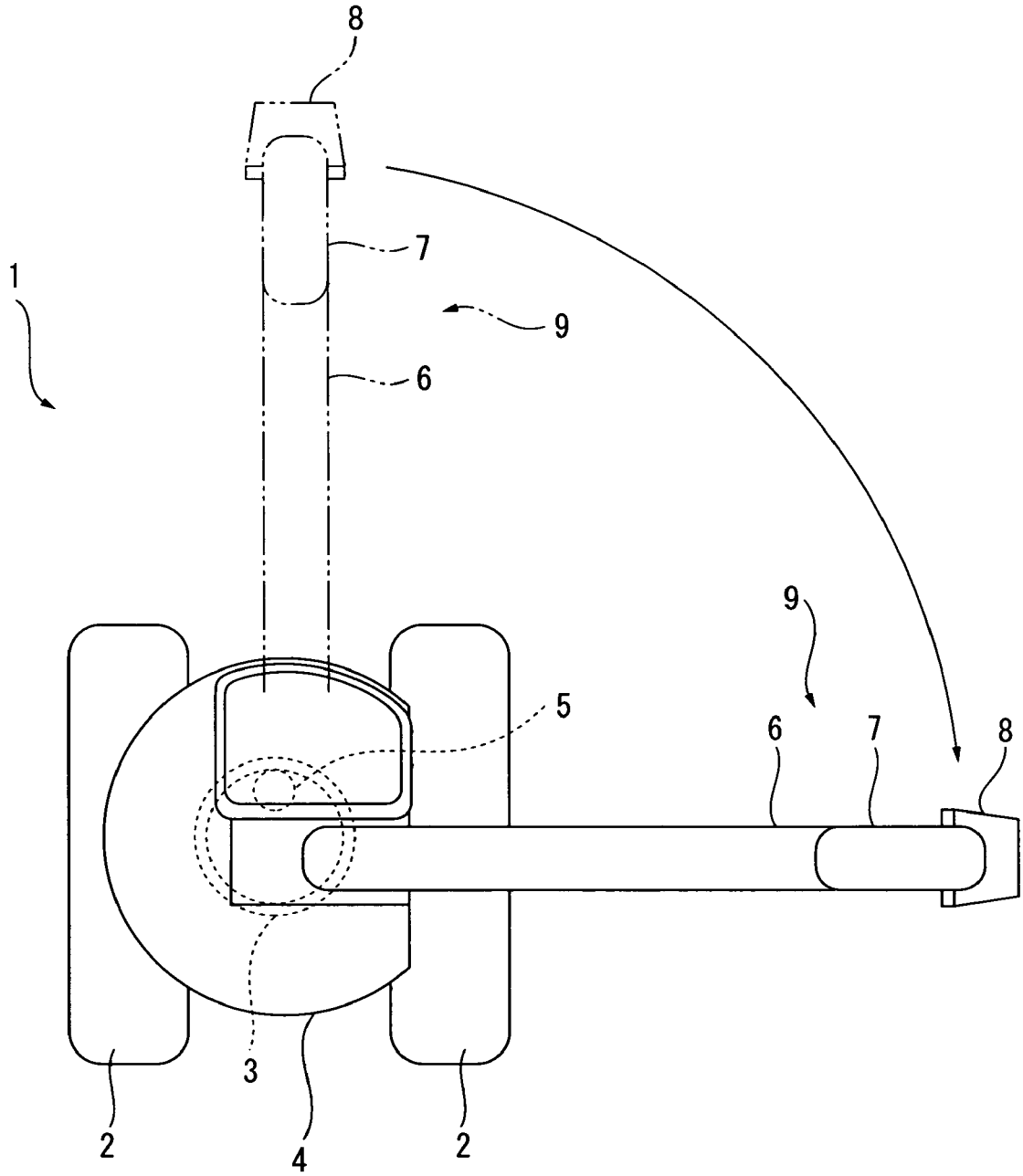
FIG. 2 is a plan view schematically showing the construction machine according to the first embodiment.
Figure 3:
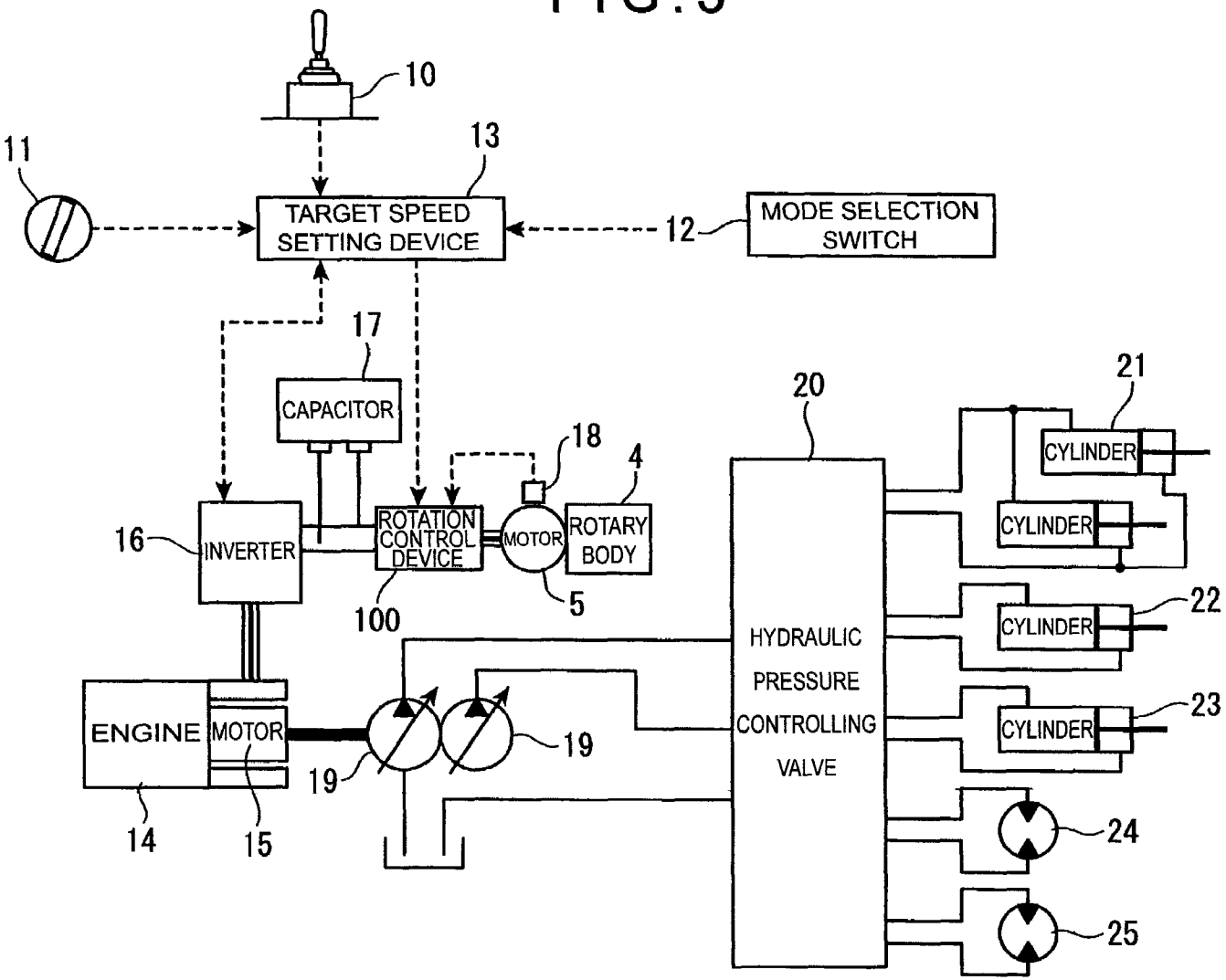
FIG. 3 is a diagram showing an overall structure of the construction machine according to the first embodiment.
Figure 4:
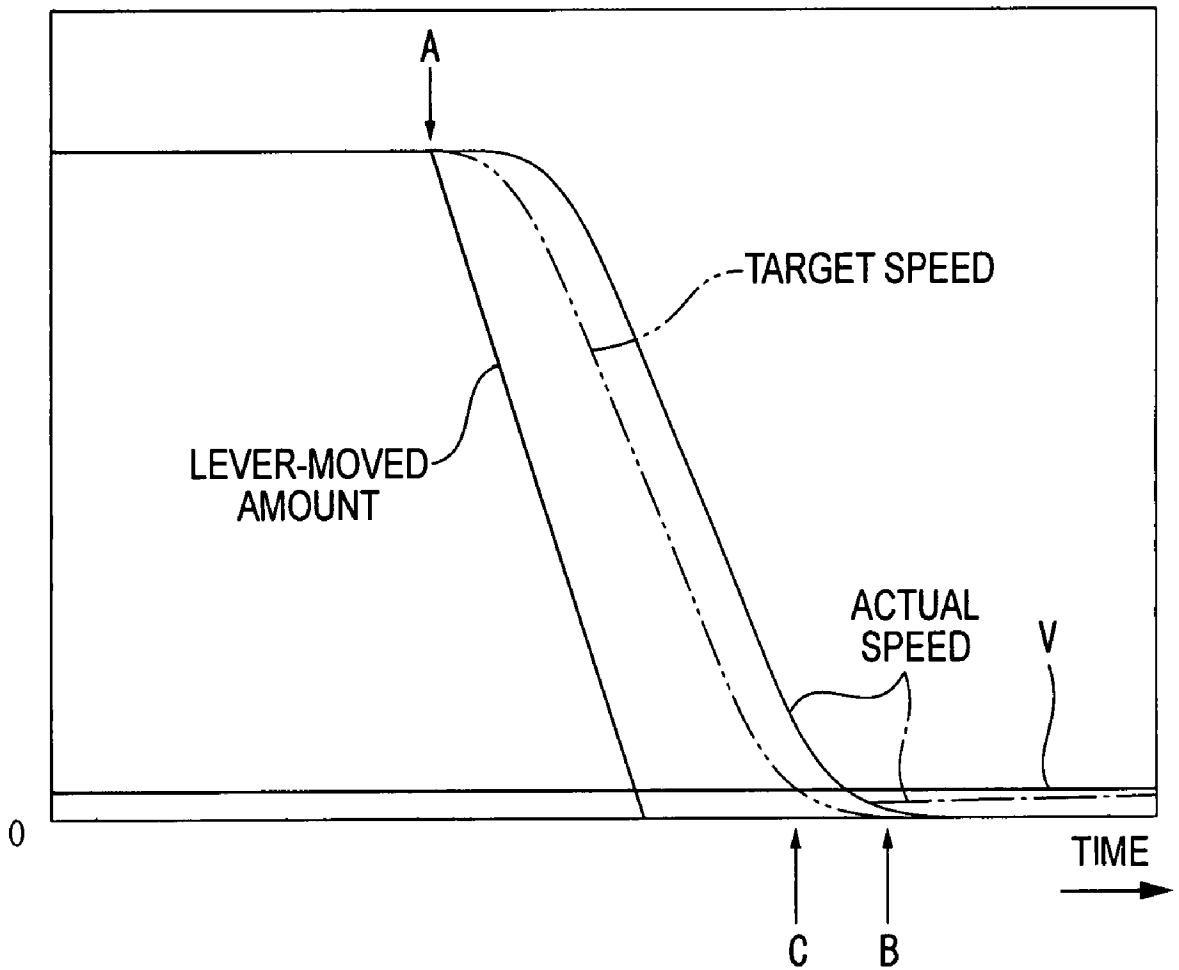
FIG. 4 is a graph explaining a control conducted according to the first embodiment.

FIG. 1A is a schematic view showing an electric rotary excavator (a construction machine) 1 according to the first embodiment, the electric rotary excavator (the construction machine) I being on a slant with a front side of a rotary body 4 oriented to the higher side of the slant. FIG. 1B is a schematic view showing the electric rotary excavator 1 of which the rotary body 4 is rotated toward the lower side of the slant and stopped (substantially at 90 degrees, see FIG. 2) to be stationary. FIG. 2 is a plan view schematically showing the electric rotary excavator 1. FIG. 3 is a block diagram showing an overall structure of the electric rotary excavator 1. FIG. 4 is a graph explaining a control of the rotary body 4 by the electric rotary excavator 1.

In FIGS. 1A, 1B and 2, the electric rotary excavator I is provided with the rotary body 4 mounted on a truck frame of a base carrier 2 via a swing circle 3. The rotary body 4 is rotated by an electric motor 5 in engagement with the swing circle 3. The rotary body 4 is provided with a boom 6 driven by a boom cylinder 21 (see FIG. 3), an arm 7 driven by an arm cylinder 22 (see FIG. 3) and a bucket 8 driven by a bucket cylinder 23 (see FIG. 3). These components form a work machine 9.

In FIG. 3, the cylinders 21 to 23 are hydraulic cylinders of which hydraulic pressure source is a hydraulic pump 19 driven by a below-described engine 14. The electric rotary excavator 1 is a hybrid construction machine with the hydraulically-driven work machine 9 and the electrically-driven rotary body 4.

As shown in FIG. 3, the electric rotary excavator 1 is also provided with a rotation lever (an operating section) 10, a fuel dial 11, a mode selection switch 12, a target speed setting device 13, the engine 14, a power-generating motor 15, an inverter 16, a capacitor 17, the electric motor 5, a rotation speed sensor 18, a hydraulic pressure controlling valve 20, a right travel motor 24, a left travel motor 25 and a rotation control device 100.

The fuel dial 11 is for controlling an amount of fuel to be supplied (injected) to the engine. The mode selection switch 12 is for changing an operation mode. An operator operates the fuel dial 11 and the mode selection switch 12 in accordance with operating conditions of the electric rotary excavator 1.

The target speed setting device 13 sets a target speed of the rotary body 4 based on a setting of the fuel dial 11, a setting of the mode selection switch 12 and an inclination angle of the rotation lever 10 (which is generally also used as a work machine lever for operating the arm 7), the target speed being output to the rotation control device 100.

The engine 14 drives the power-generating motor 15 and the hydraulic pump 19 that is the hydraulic pressure source for the hydraulic cylinders 21 to 23. The hydraulic pressure generated by the hydraulic pump 19 is used by the boom cylinder 21 to drive the boom 6 (see FIG. 2), by the arm cylinder 22 to drive the arm 7 (FIG. 2) and by the bucket cylinder 23 to drive the bucket 8 (FIG. 2). The right travel motor 24 and the left travel motor 25 are hydraulic motors, for which the hydraulic pump 19 is used as a hydraulic pressure source.

The power-generating motor 15, the inverter 16 and the capacitor 17 serve in combination as an electric power source for the electric motor 5. Note that the power-generating motor 15 also works as an electricity generator with functions of an electric motor.

The electric motor 5 rotates the rotary body 4 via the swing circle 3. The rotation speed sensor 18 is attached to the electric motor 5. The rotation speed sensor 18 detects a rotation speed of the electric motor 5 and feeds the detected rotation speed back to the rotation control device 100.

The rotation control device 100 conducts a speed control through a P-control (a proportional control) with a speed gain K (a control gain) based on the target speed of the rotary body 4 set by the target speed setting device 13 and the rotation speed of the electric motor 5 detected by the rotation speed sensor 18. The rotation control device 100 generates a torque command value (a control command) to the electric motor 5. In the first embodiment, the rotation control device 100 is an inverter that inverts the torque command value to a current value and a voltage value to output to the electric motor 5, thereby controlling a torque output of the electric motor 5.

Note that the rotation control device 100 may not be an inverter as long as the rotation control device 100 can provide a command for driving the electric motor, for example, by switching.

When the electric rotary excavator 1 is speed-controlled on a slant as shown in FIGS. 1B and 2 and the rotary body 4 is to be stopped in a rotation toward the lower side of the slant, the rotary body 4 may not be completely stopped due to the weight of the boom 6 or the arm 7 and coast to a lowest position. This will be described in detail below with reference to FIG. 4.

FIG. 4 shows a relation among an operation amount of the rotation lever 10, the target speed of the rotary body 4 and an actual speed of the electric motor 5, the relation being seen when the operator returns the rotation lever 10 to the neutral position to stop the rotary body 4. When the operator starts to return the rotation lever 10 from the point indicated by arrow A (along the solid linear line), the target speed setting device 13 follows that returning operation with a slight delay to lower the target speed (along the dashed-two dotted line). Since the rotation control device 100 controls the rotary body 4, the actual speed also follows the change of the target speed with a slight delay (along the solid curved line). The actual speed is changed because the electric motor 5 outputs a braking torque depending on a deviation between the target speed and the actual speed.

When the rotation lever 10 is completely returned to the neutral where the operation amount is "0", the target speed setting device 13 sets the target speed so as to become "0" at the point indicated by arrow B. Thus, the actual speed of the rotary body 4 is lowered to "0". However, in the above-described speed control, since the weight of the boom 6 or the arm 7 is very large, the weight may exceed the braking torque, resulting in that the rotary body 4 coasts toward the lower side, making a slow rotation shown in the dashed-one dotted line. The braking torque is continuously generated during the slow rotation based on a small deviation between the actual speed shown in the dashed-one dotted line and the target speed "0". Still, since the speed gain K is set to be relatively small in consideration of the controllability of the electric rotary excavator 1, the weight of the boom 6 or the arm 7 may exceed the braking torque even when a maximum braking torque for the deviation is generated.

The rotation control device 100 of the first embodiment changes the control law from the speed control to a position control at the point (indicated by arrow C) where the target speed becomes smaller than a speed threshold value V as shown in FIG. 4. The control law has been already changed at least by the time when the target speed becomes "0", so that the actual speed can be lowered along the curved line to "0", thereby reliably stopping the rotary body 4 and maintaining a stationary state thereof at the stop position.

Figure 5:
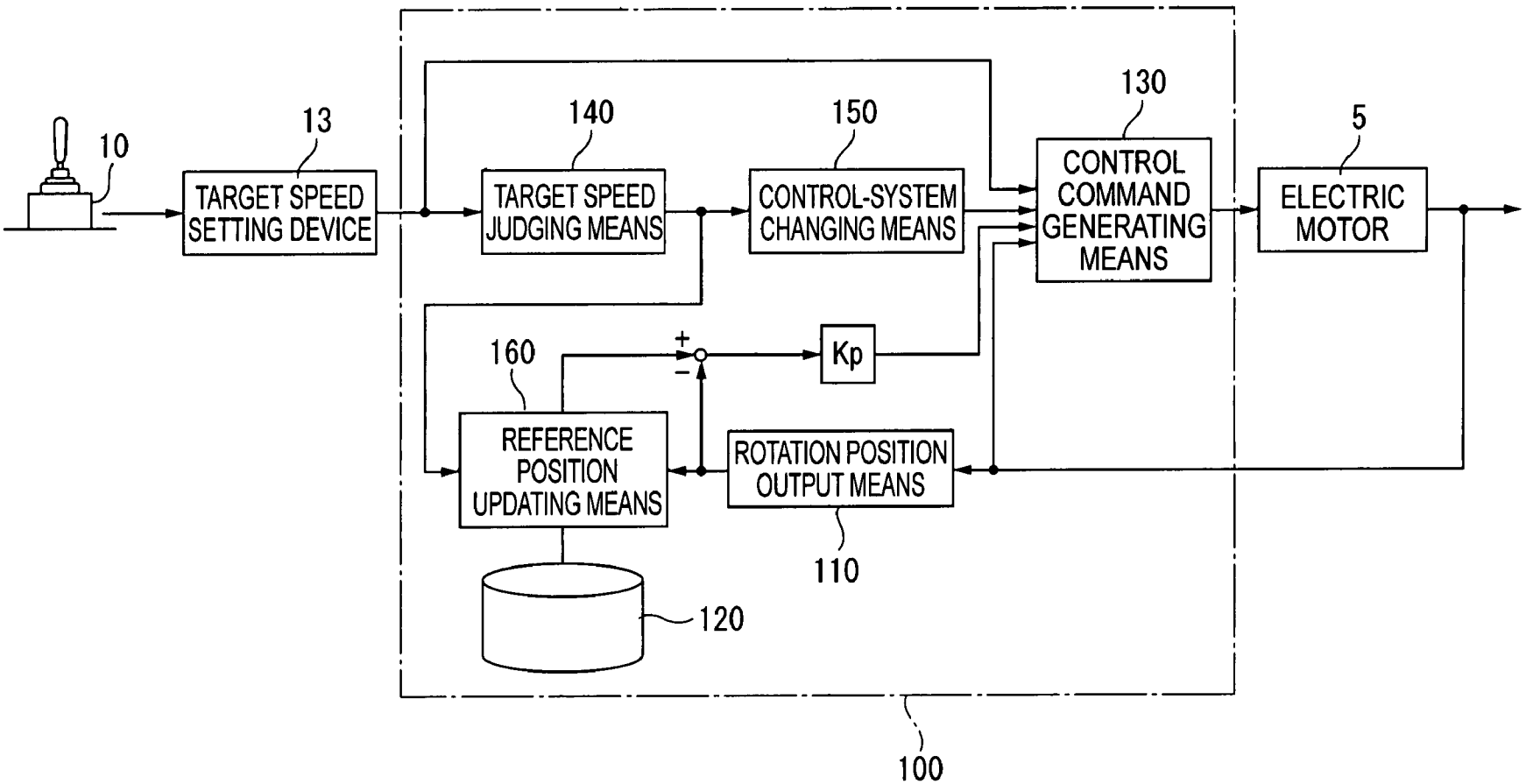
FIG. 5 is a block diagram showing a control structure of a rotary control device according to the first embodiment.

As shown in FIG. 5, the rotation control device 100 of the first embodiment is provided with a target speed judging means 140 for judging whether or not the target speed becomes smaller than the speed threshold value V shown in FIG. 4 and a control-system changing means 150 for changing the control law from the speed control to the position control in accordance with the judgment result of the target speed judging means 140.

[1-2] Structure of Rotation Control Device 100

Figure 6:
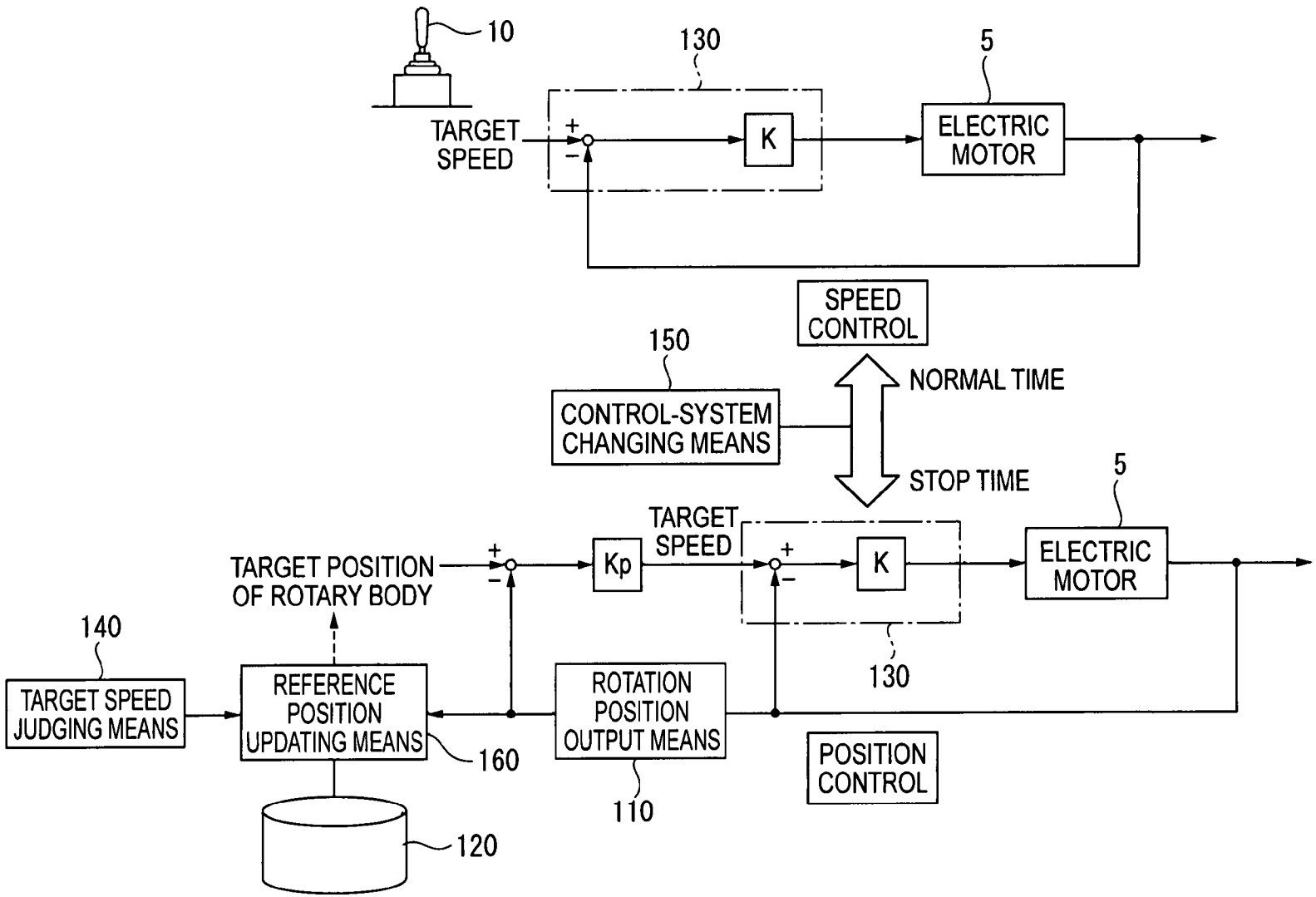
FIG. 6 is another diagram explaining the control conducted according to the first embodiment.

A control structure of the rotary body 4 by the rotation control device 100 will be described below with reference to FIGS. 5 and 6.

The rotation control device 100 includes a rotation position output means 110, the control command generating means 130, the target speed judging means 140, the control-system changing means 150, a reference position storage means 120 and a reference position updating means 160.

The rotation position output means 110 integrates the rotation speed of the electric motor 5 from the rotation speed sensor 18 to output the integration result as a rotation position information of the rotary body 4.

The reference position storage means 120, which may be a RAM (Random Access Memory), stores an output value by the rotation position output means 110 as a reference position. The reference position stored in the reference position storage means 120 is updated with each rotation position of the rotary body 4 in accordance with the judgment result by the target speed judging means 140.

The control command generating means 130 generates and outputs a control command for the electric motor 5. As shown in FIG. 6, the control command generating means 130 conducts two types of control by changing the control law. One is the speed control in which the P-control (P: proportional) is conducted based on the target speed of the rotary body 4 set by the- target speed setting device 13 and the rotation speed of the electric motor 5 detected by the rotation speed sensor 18. The other is the position control in which the P-control (proportional control) is conducted based on the output value from the rotation position output means 110 and the reference position stored in the reference position storage means 120. The control command generating means 130 employs the speed control as a regular controlling in operations other than stopping the rotary body 4 such as starting a rotation of the rotary body 4 and increasing and decreasing the rotation speed of the rotary body 4 during the rotation.

In the speed control, the control command generating means 130 compares the target speed set by the target speed setting device 13 with the rotation speed of the electric motor 5 fed back to the rotation control device 100. The control command generating means 130 then multiplies the deviation therebetween by the speed gain K to generate a torque command value (a control command) to the electric motor 5. The speed gain K herein is set in consideration of the controllability of the electric rotary excavator 1. If the speed gain K is too large, the torque is output too rapidly, which may cause non-smooth movement of the rotary body 4. A too small speed gain K may cause too slow movement of the rotary body 4.

Thus, the torque command value of the electric motor 5 is generated in accordance with the deviation between the target speed and the fed-back rotation speed of the electric motor 5. When the actual rotation speed is not increased even by greatly inclining the rotation lever 10, the control command generating means 130 increases the torque command value so as to raise the actual speed toward the target speed. Note that such a control is a normal speed control using the P-control.

When the control law is changed by the control-system changing means 150, the control command generating means 130 conducts the position control. In FIG. 6, the value of the speed gain K in the position control is not different from that in the speed control, but the control command generating means 130 amplifies the deviation between the rotation position fed back by the rotation position output means 110 and the reference position stored in the reference position storage means 120 by multiplying the deviation therebetween by a position gain Kp, thereby generating a higher target speed than that generated by the target speed setting device 13. The control command generating means 130 generates a larger torque command value than that in the speed control, so that the braking torque output by the electric motor 5 becomes larger. As described above, the rotation control device 100 balances the weight of the boom 6 or the arm 7 with the braking torque to maintain the rotary body 4 in a stationary state.

The target speed judging means 140 judges whether or not the operator demands to stop the rotary body 4. Specifically, the target speed judging means 140 judges whether or not the target speed of the electric motor 5 generated by the target speed setting device 13 becomes smaller than the predetermined threshold value.

In accordance with the judgment result by the target speed judging means 140, the control-system changing means 150 makes a change in the control law of the control command generating means 130 as a change of the control system of the rotation control device 100.

This change of the control law by the target speed judging means 140 and the control-system changing means 150 will be described in detail later.

The reference position updating means 160 updates the reference position stored in the reference position storage means 120 in accordance with the judgment result by the target speed judging means 140. Specifically, the reference position updating means 160 updates by replacing the reference position stored in the reference position storage means 120 with the output value from the rotation position output means 110 in a normal operation by the operator other than stopping of the rotary body 4. After the target speed judging means 140 judges that the target speed is "0", the reference position is not updated but maintains the same value. This reference position is the position at which the rotary body 4 is to be stopped, that is, a target position of the rotary body.

[1-3] Controlling by Rotation Control Device 100

Figure 7:
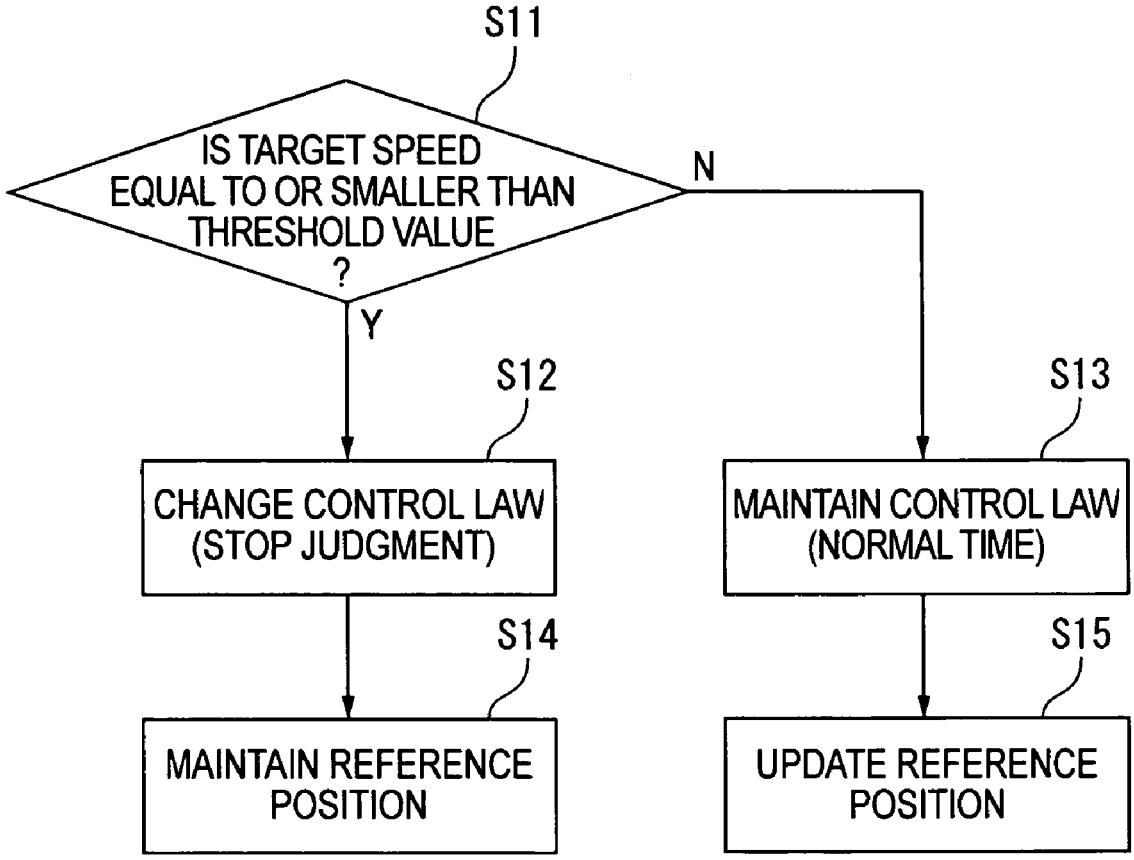
FIG. 7 is a flowchart according to the first embodiment.

Now the change of the control law of the rotation control device 100, especially the change of the control law by the target speed judging means 140 and the control-system changing means 150 will be described with reference to FIG. 7.

When the rotation lever 10 is returned to the neutral in the operation for stopping the rotary body 4, the target speed judging means 140 judges whether or not the target speed is equal to or smaller than the speed threshold value V (Step 11; "Step" will be abbreviated as "S" in the description below and in the figures). That is , whether or not the rotation lever 10 is returned to the neutral by the operator, that is, whether or not the operator demands to stop the rotary body 4 is judged.

When the target speed is equal to or smaller than the speed threshold value V, the control-system changing means 150 changes the control law of the control command generating means 130 from the speed control to the position control (S12). Note that the control command is generated in the speed control and the position control in the same manner as described above with reference to FIG. 4.

Herein, the reference position updating means 160 maintains the reference position stored in the reference position storage means 120 (S14).

When the target speed is not equal to or smaller than the speed threshold value V, the control-system changing means 150 does not change the control law of the control command generating means 130 and continues the speed control (S13). When the operation for rotating the rotary body 4 starts, the control law is changed to the speed control from the position control.

Herein, the reference position updating means 160 updates the reference position stored in the reference position storage means 120 (S15).

[1-4] Advantages and Effects of First Embodiment

The first embodiment provides following advantages and effects.

(1) In rotating the rotary body 4 of the electric rotary excavator 1, the control-system changing means 150 of the rotation control device 100 changes the control law from the speed control to the position control when the target speed is judged to be smaller than the speed threshold value V. Hence, a larger braking torque can be output to the electric motor 5 as compared with a case in the speed control, whereby reliably maintaining the rotary body 4 in a stationary state.

(2) However, the speed gain K is not increased to generate the larger braking torque output in the electric motor 5, so that a too large torque is not generated in a normal rotating operation, thereby preventing non-smooth movement of the electric rotary excavator 1 and providing a comfortable ride and the good controllability of the electric rotary excavator 1.

SECOND EMBODIMENT

Figure 8:
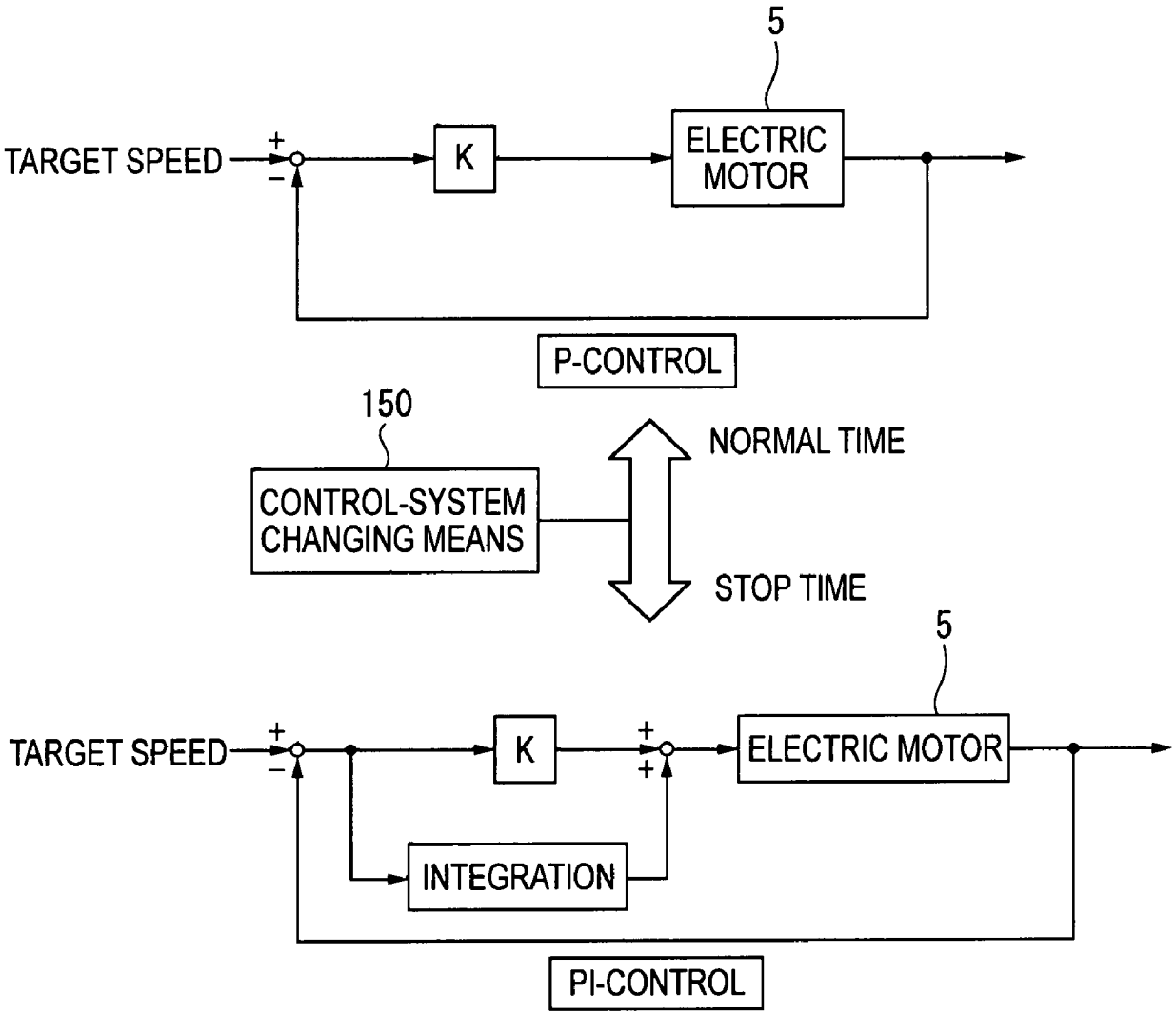
FIG. 8 is a diagram explaining a control conducted according to a second embodiment.

FIG. 8 shows a second embodiment of the invention.

In the second embodiment, the control-system changing means 150 of the rotation control device 100 makes a change of the control law of the control command generating means 130 from the speed control using the P-control to a speed control using a PI control (PI: Proportional Integral) as a change of the control system of the rotation control device 100. The second embodiment does not employ the position control, so that the rotation position output means, the reference position storage means and the reference position updating means of the first embodiment are not provided. The other structure is the same as the first embodiment.

According to the second embodiment, in the normal speed control with the P-control, the deviation between the target speed and the actual speed after the target speed becomes "0" is regarded as a remaining deviation. Accordingly, the actual speed does not become the target speed "0" and it is difficult to maintain the stationary state. However, in the speed control with the PI-control by the control command generating means 130, a small remaining deviation temporally accumulates to a predetermined amount. On reaching the predetermined amount, the torque command is added to eliminate the deviation. Hence, the rotation control device 100 can output a larger braking torque as compared with the normal control, thereby reliably maintaining the rotary body 4 in a stationary state.

Further, since the speed gain K remains the same, a comfortable ride and the good controllability can be maintained.

THIRD EMBODIMENT

Figure 9:
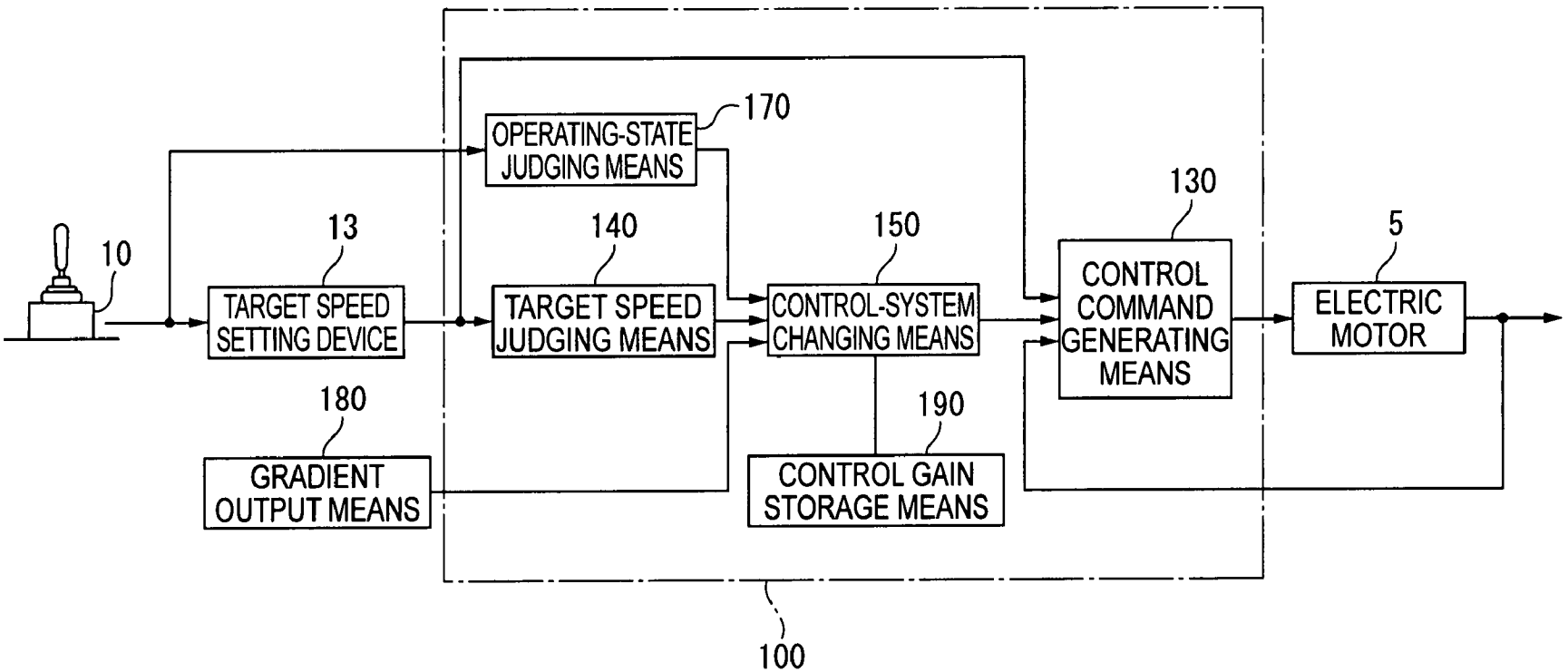
FIG. 9 is a block diagram showing a control structure of a rotary control device according to a third embodiment.
Figure 10:
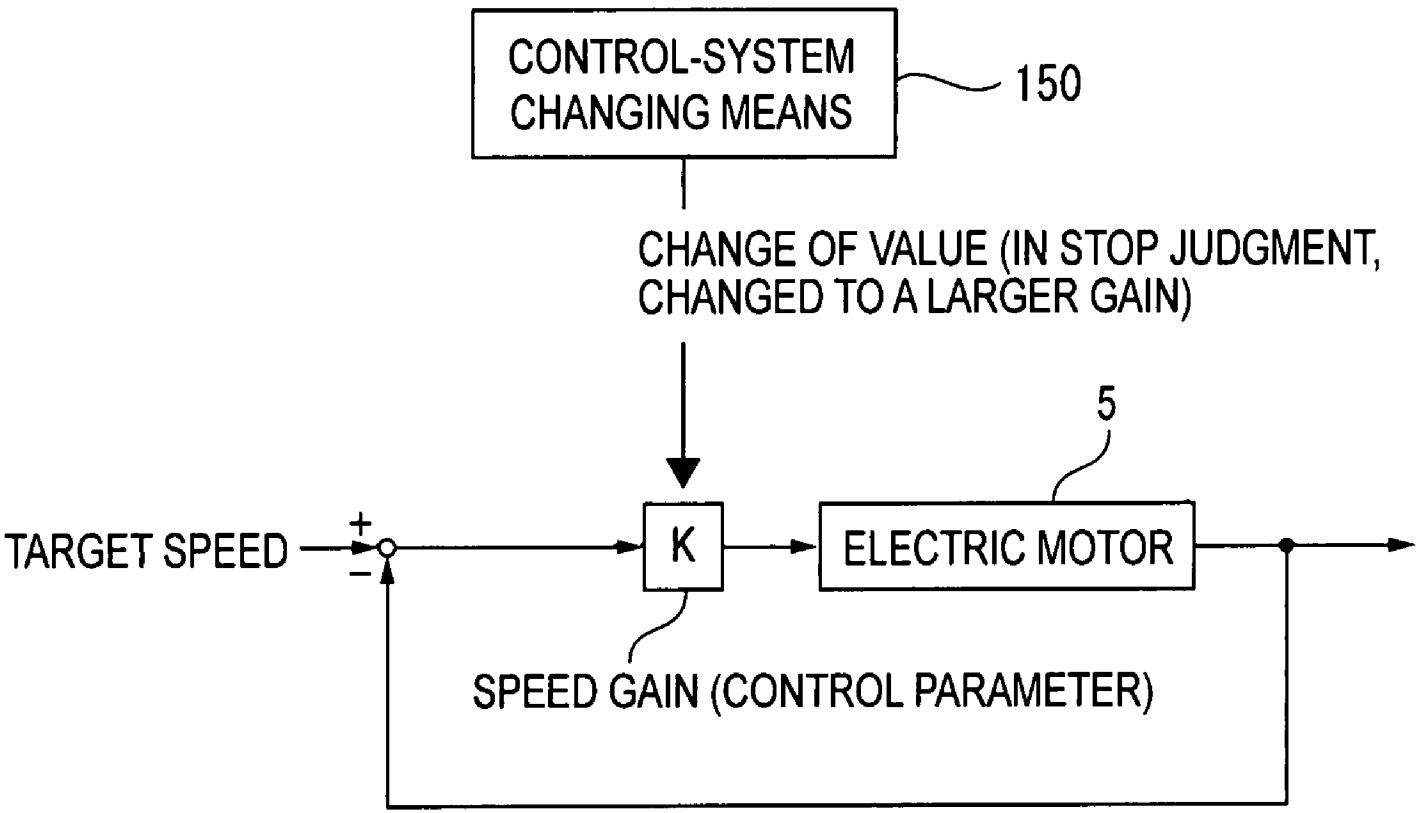
FIG. 10 is a diagram explaining a control conducted according to the third embodiment.

FIGS. 9 and 10 each show a third embodiment of the invention.

As shown in FIG. 9, the rotation control device 100 of the third embodiment includes an operating-state judging means 170, the control command generating means 130, the target speed judging means 140, the control-system changing means 150 and a control gain storage means 190.

In the third embodiment, the control law of the control command generating means 130 is not changed. As shown in FIG. 10, by changing the speed gain K (the control gain) to have a larger value, the rotary body 4 is maintained in a stationary state. A plurality of speed gains for the rotary body 4 which are used for changing the speed gain is stored in the control gain storage means 190.

As shown in FIG. 9, the third embodiment includes the operating-state judging means 170 for judging whether or not the operation amount of the rotation lever 10 is "0", that is, whether or not the rotation lever 10 is at the neutral position. Accordingly, it is judged whether or not the operation by the operator is intended to completely stop the rotary body 4.

As shown in FIG. 9, the electric rotary excavator 1 (see FIG. 2) of the third embodiment is provided with a gradient output means 180 for outputting information on the gradient of the slant on which the electric rotary excavator 1 is working to the control-system changing means 150.

The control-system changing means 150 makes a change of the speed gain in accordance with the judgment results by the operating-state judging means 170 and the target speed judging means 140 as a change of the control system of the rotation control device 100. Herein, in accordance with an output signal by the gradient output means 180, the control-system changing means 150 calls a value of the speed gain K appropriate to the gradient from the control gain storage means 190 to replace the current speed gain K with the called speed gain K. A table or a map is stored in the control gain storage means 190, in which gradients and speed gains are associated to each other.

Note that the control command generating means 130 of the third embodiment conducts the same speed control as the control command generating means 130 of the first embodiment. Similarly, the target speed judging means 140 is the same as the first embodiment. Hence, no description is given here for the control command generating means 130 and the target speed judging means 140. In addition, since the third embodiment does not employ the position control, the rotation position output means, the reference position storage means and the reference position updating means of the first embodiment are not provided.

Advantages and effects of the rotation control device 100, especially of the target speed judging means 140, the operating-state judging means 170 and the control-system changing means 150 will be described below with reference to FIG. 11.

Figure 11:
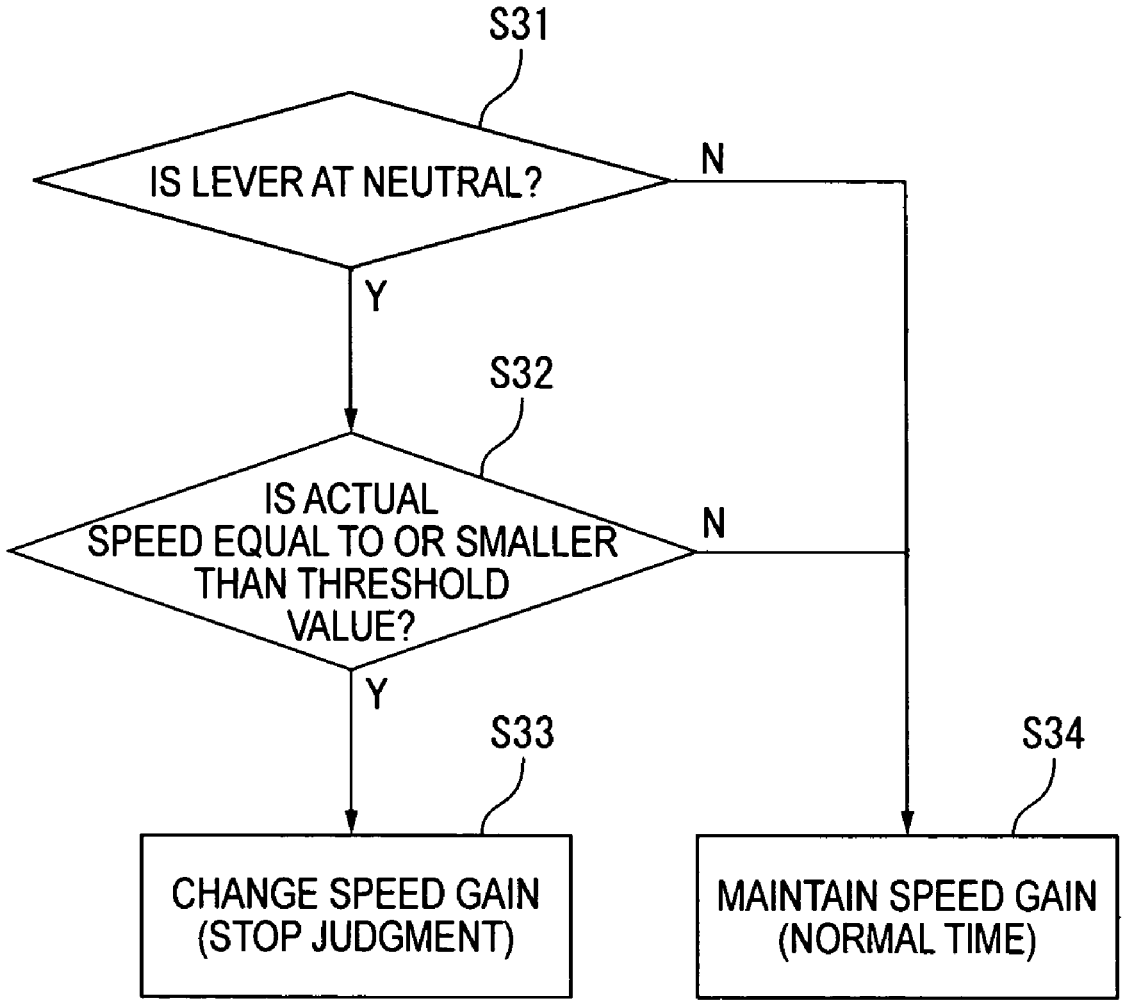
FIG. 11 is a flowchart according to the third embodiment.

In FIG. 11, when the operating-state judging means 170 judges that a signal indicating the operation amount of the rotation lever 10 is "0" (see FIG. 9) and the rotation lever 10 is at the neutral (S31); and the target speed judging means 140 judges that the target speed is smaller than the speed threshold value V (S32), the control-system changing means 150 changes the normal speed gain K to a larger speed gain based on the output signal from the gradient output means 180 (S33). In S31 or S32, when the rotation lever 10 is not at the neutral or when the target speed is not smaller than the speed threshold value V, the ongoing operation is judged to be a rotating operation other than the stopping operation. The control-system changing means 150 does not change the speed gain K (S34).

However, also in the third embodiment, the control-system changing means 150 changes the speed gain K to a larger value in order to output a larger braking torque when the ongoing operation is the stopping operation, thereby maintaining the rotary body 4 in a stationary state.

Since the speed gain K is changed to a larger value only when the ongoing operation is judged to be the stopping operation, the speed gain K can be small in the rotation operation other than the stopping operation, thereby preventing degradation in comfort of the ride and the controllability.

A particular arrangement according to the third embodiment provides further advantages and effects as described below.

(3) The speed gain K is changed in the stopping operation to a value selected depending on the gradient of the slant. When the gradient of the slant is large, a speed gain K having a very large value is called and used. When the gradient is small, the speed gain K having a slightly larger value than the current value is used, the slightly larger value being the minimum value to handle the gradient. Thus, an accurate control in accordance with the degree of the gradient can be provided.

It should be noted that the present invention is not limited to the aforesaid embodiments but includes other arrangements and the like through which an object of the invention can be attained. The invention also includes modifications exemplified below.

Figure 12:
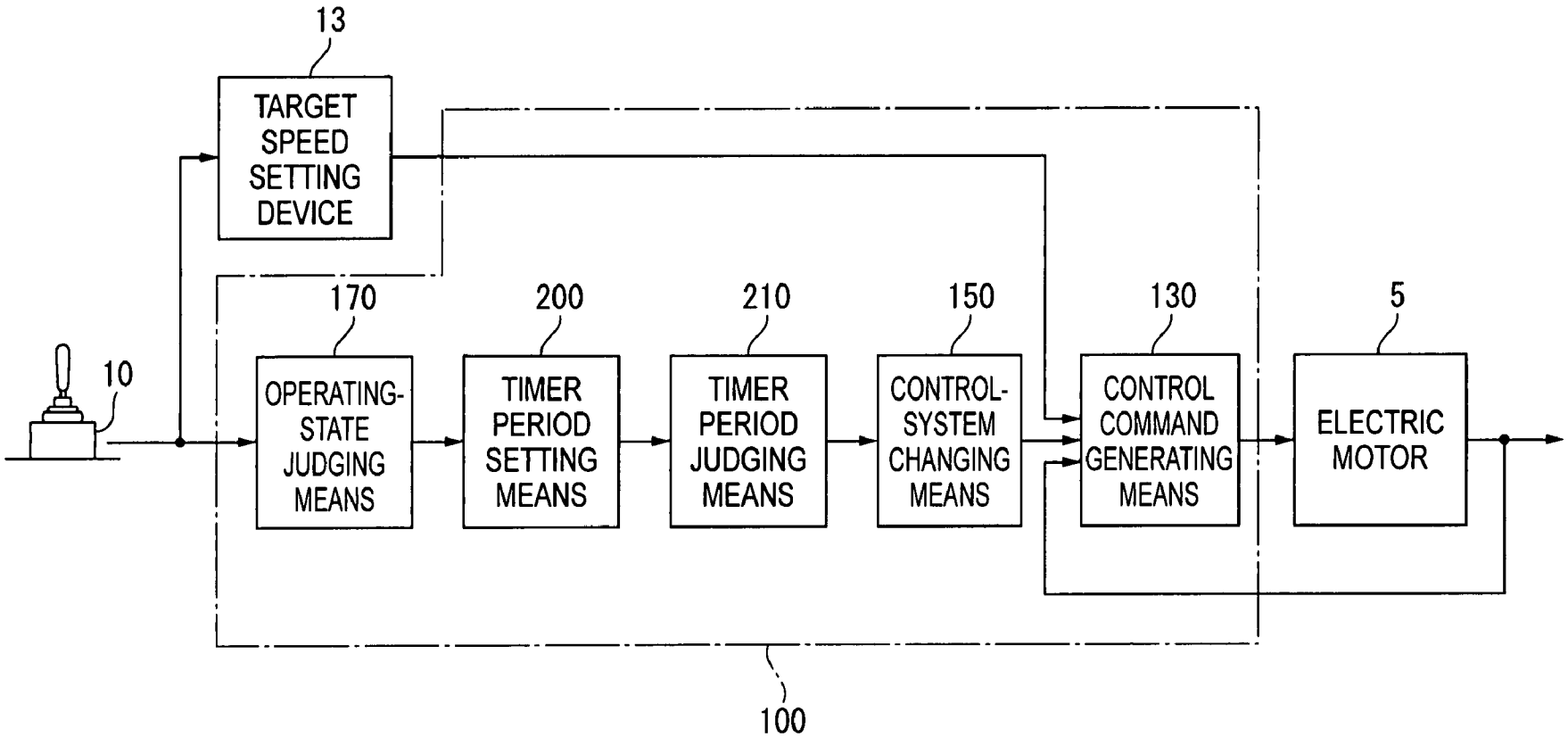
FIG. 12 is a block diagram showing a control structure according to a modification of the invention.

For example, in the aforesaid embodiments, the control law or the speed gain K is changed when the target speed judging means 140 judges that the target speed is smaller than the speed threshold value V. However, as shown in FIG. 12, a timer period setting means 200 and a timer period judging means 210 may be provided in place of the target speed judging means 140.

Figure 13:
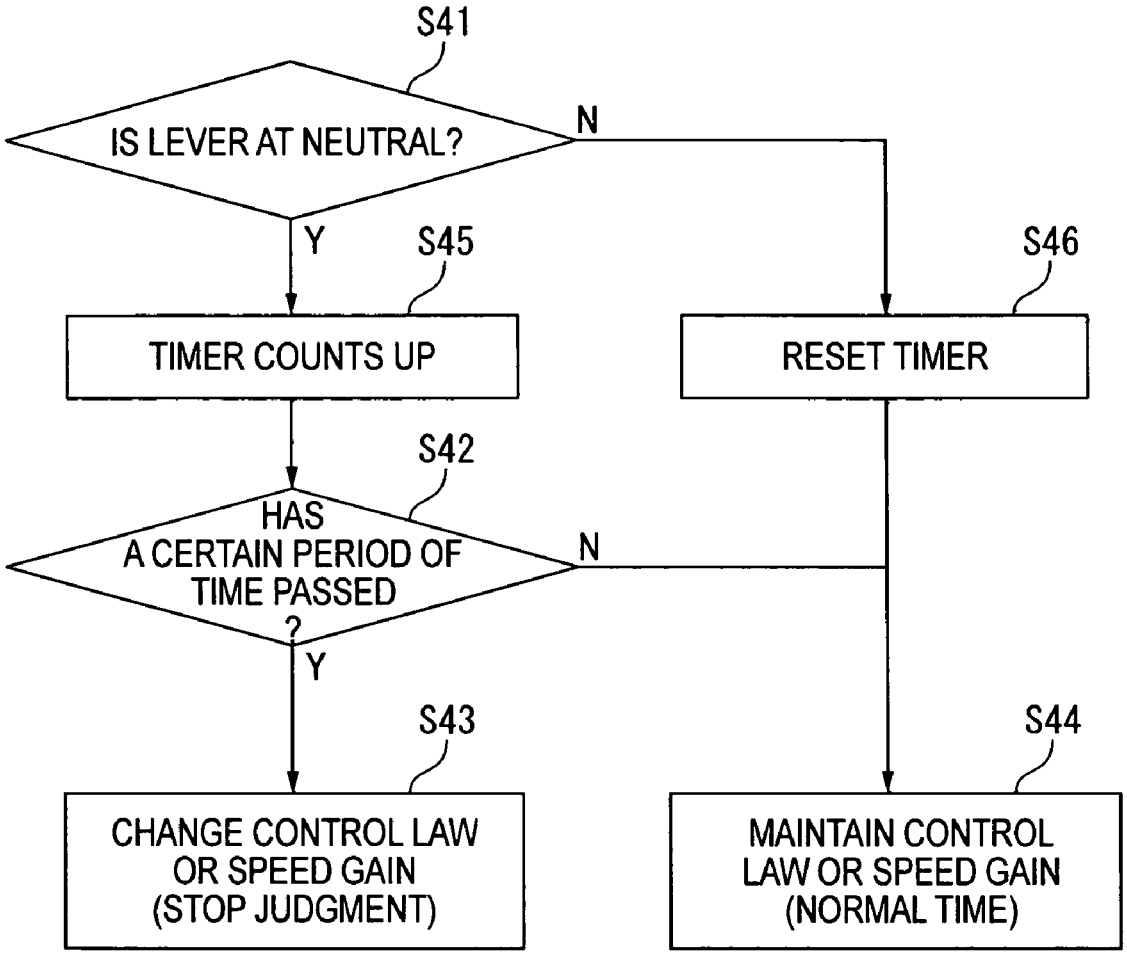
FIG. 13 is a flowchart according to the modification.

In such an alternative arrangement, as shown in FIG. 13, the timer period judging means 210 judges whether or not a certain period of time has passed from a time point when the rotation lever 10 is placed at the neutral (S42). When the timer period judging means 210 judges that the certain period of time has passed, the control-system changing means changes the control law or the speed gain (S43). Note that the period of time is set by the timer period setting means 200 in accordance with the judgment result by the timer period judging means 210 (S45, S46).

In this modification example, it is assumed that the target speed is lowered toward "0" after the certain period of time has passed. The assumption is satisfied by judging whether or not the rotation lever 10 is at the neutral in S41. Although the timer period judging means does not monitor the target speed directly, the timer period judging means indirectly judges that the target speed of the rotary body 4 becomes smaller than a predetermined threshold value based on the elapse of the time. Hence, the timer period judging means is a judging means according to the present invention.

In the aforesaid embodiments, changing a control parameter is explained by exemplifying the speed gain K (the control gain). However, the arrangement is not limited thereto. As another example, in the electric rotary excavator 1 that includes a mechanical braking device and is controlled such that a braking device actuating command is automatically output in five seconds counted from a time point when the target speed becomes "0" in a normal control, a parameter for output timing may be changed such that the actuating command is output at an earlier timing (for example, in two seconds or less) when the electric rotary excavator 1 is on a slant. In this exemplary arrangement, by providing the gradient output means 180, it is possible to judge whether or not the timing is to be changed and it is possible to change the timing in accordance with the gradient.

In addition to the case in which the target speed becomes smaller than the speed threshold value V, the control law or the control parameter may be changed when the actual speed becomes smaller than a speed threshold value for the actual speed, the actual speed threshold value being set in advance. If the control law or the control parameter has been changed by the time when the target speed becomes "0", such arrangement is also an aspect of the invention.

The control law to be used after the change, the control parameter to be changed, the way for timing the change and the like are not limited to the above-described combinations, but any combination may be employed in order to embody the invention.

Although the best modes, ways and the like for implementing the invention have been disclosed above, the present invention is not limited thereto. In other words, some aspects of the invention are illustrated in the drawings and have been described above in detail by exemplifying the certain embodiments, but it is obvious that a skilled person in the art can add various changes to the aforesaid embodiments without departing from the technical idea and the scope of the invention.

INDUSTRIAL APPLICABILITY

The present invention may be applied to any construction machine of which rotary body is rotated by an electric motor.

The invention claimed is:

1. A rotation control device that is applied to a construction machine on which a work machine is mounted, the rotation control device controlling a rotation of a rotary body driven by an electric motor, comprising:

control command generating means for generating and outputting a control command for the electric motor;

target speed judging means for, when an operating section is at a neutral position, judging whether or not a target speed of the rotary body which is generated based on an operation amount of the operating section is smaller than a predetermined threshold value; and control-system changing means for changing a control system of the rotation control device in accordance with a judgment result by the target speed judging means.

2. The rotation control device according to claim 1, further comprising:

reference position updating means for updating a reference position in accordance with the judgment result by the target speed judging means;

wherein the control-system changing means makes as a change of the control system, a change in a control law of the control command generating means from at least one of: (i) a speed control law for controlling a rotation speed of the rotary body to a position control law for controlling a rotation position of the rotary body based on the rotation position and the reference position, and (ii) from a proportional control law based on a deviation between the target speed and an actual speed of the rotary body to a proportional-plus-integral control law based on the deviation.

3. The rotation control device according to claim 1, wherein the control-system changing means changes a speed gain of the control command generating means as a change of the control system.

4. The rotation control+ device according to claim 3, wherein the control-system changing means changes the speed gain from a small gain to a large gain.

5. A rotation control method that is applied to a construction machine on which a work machine is mounted, wherein the rotation control method controls a rotation of a rotary body driven by an electric motor, said method comprising:

generating and outputting a control command for the electric motor;

when an operating section is at a neutral position, judging whether or not a target speed of the rotary body which is generated based on an operation amount of the operating section is smaller than a predetermined threshold value; and changing a control system of the rotation control method when the target speed is judged to be smaller than the predetermined threshold value.

6. The rotation control method according to claim 5, further comprising:

updating a reference position in accordance with the judgment;

wherein in the step for changing the control system of the rotation control method, a control law in the step for generating and outputting the control command is changed from at least one of: (i) a speed control law for controlling a rotation speed of the rotary body to a position control law for controlling a rotation position of the rotary body based on the rotation position and the reference position; and (ii) a proportional control law based on a deviation between the target speed and an actual speed of the rotary body to a proportional-plus-integral control law based on the deviation.

7. The rotation control method according to claim 5, wherein in the step for changing the control system of the rotation control method, a speed gain in the step for generating and outputting the control command is changed.

8. A construction machine on which a work machine is mounted, comprising:

a rotary body rotated by an electric motor; and a rotation control device which controls a rotation of the rotary body;

wherein the rotation control device includes:

control command generating means for generating and outputting a control command for the electric motor;

target speed judging means for, when an operating section is at a neutral position, judging whether or not a target speed of the rotary body which is generated based on an operation amount of the operating section is smaller than a predetermined threshold value; and control-system changing means for changing a control system of the rotation control device in accordance with a judgment result by the target speed judging means.

9. The construction machine according to claim 8, further comprising:

reference position updating means for updating a reference position in accordance with the judgment result by the target speed judging means;

wherein the control-system changing means makes as a change of the control system, a change in a control law of the control command generating means from at least one of: (i) a speed control law for controlling a rotation speed of the rotary body to a position control law for controlling a rotation position of the rotary body based on the rotation position and the reference position, and (ii) a proportional control law based on a deviation between the target speed and an actual speed of the rotary body to a proportional-plus-integral control law based on the deviation.

10. The construction machine according to claim 8, wherein the control-system changing means changes a speed gain of the control command generating means as a change of the control system.

11. The construction machine according to claim 10, wherein the control-system changing means changes the speed gain from a small gain to a large gain.

* * * * *